US008567557B2

(12) United States Patent
Kuepfer et al.

(10) Patent No.: US 8,567,557 B2
(45) Date of Patent: Oct. 29, 2013

(54) SOUND-MUFFLING UNDERLAY TILE SYSTEMS

(76) Inventors: Rob Kuepfer, Kitchener (CA); William Hardin, Kingston, GA (US)

( * ) Notice: Subject to any disclaimer, the term of this patent is extended or adjusted under 35 U.S.C. 154(b) by 0 days.

(21) Appl. No.: 13/334,457

(22) Filed: Dec. 22, 2011

(65) Prior Publication Data

US 2012/0167370 A1 Jul. 5, 2012

Related U.S. Application Data

(60) Provisional application No. 61/429,488, filed on Jan. 4, 2011.

(51) Int. Cl.
*E04B 1/82* (2006.01)

(52) U.S. Cl.
USPC ..... 181/290; 181/284; 52/403.1

(58) Field of Classification Search
USPC ..... 181/290; 52/403.1
See application file for complete search history.

(56) References Cited

U.S. PATENT DOCUMENTS 5,052,157 A * 10/1991 Ducroux et al. ..... 52/126.6
5,867,957 A 2/1999 Holtrop
6,576,577 B1 * 6/2003 Garner ..... 442/374
7,886,488 B2 2/2011 Payne, Jr. et al.
7,987,645 B2 8/2011 Tinianov
2004/0016184 A1 1/2004 Huebsch et al.
2005/0193670 A1 * 9/2005 Niese et al. ..... 52/403.1
2006/0230699 A1 * 10/2006 Keene ..... 52/480
2008/0010931 A1 * 1/2008 Pervan et al. ..... 52/403.1
2009/0313915 A1 * 12/2009 Kellner ..... 52/105
2011/0030300 A1 * 2/2011 Liu ..... 52/403.1

* cited by examiner

*Primary Examiner* — Forrest M Phillips
(74) *Attorney, Agent, or Firm* — RG Patent Consulting, LLC; Rachel Gilboy

(57) ABSTRACT

Sound muffling flooring underlay tile systems using sonic foam-enhanced underlay board may comprise a sound-muffling tile assembly for installation underneath a floor surface to help minimize sound transfer between living areas and to provide increased insulation. The sound-muffling tile assembly may comprise a flooring base member, a cushioning film layer, and a fastener for securing the flooring base member to the cushioning film layer. In one embodiment of the present invention, the cushioning film layer may comprise a foam substance comprising an open-cell structure. In addition to actively dampening sound waves that travel through the open-cell structure of the foam substance, the cushioning film layer provides a floated surface for the floor above the sound-muffling tile assembly when installed.

19 Claims, 6 Drawing Sheets

SOUND-MUFFLING UNDERLAY TILE SYSTEMS

CROSS-REFERENCE TO RELATED APPLICATION

The present application is related to and claims priority from prior provisional application Ser. No. 61/429,488, filed Jan. 4, 2011 which application is incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of floor tiling systems and more specifically relates to an improved sound-muffling flooring and tiling system for installation on a planar surface for dampening sound waves thereby reducing sound from traveling in various directions when a user travels across the flooring, while also providing smooth and level surfaces for flooring installation.

2. Description of the Related Art

Members of today's society often live in close quarters to one another as the world's population is constantly increasing. Consequently, it is not uncommon for people to share a common dwelling space, living within close proximity. For example, apartment complexes may provide multi-level buildings for people to occupy and live on different floors within a commercial dwelling. Occupants who may live on a level with other occupants living above may experience noise disturbances when the upstairs occupants move across their floors. Many times, this results in noise pollution traveling from floor to floor. This may cause high noise levels for the individuals living below, which may ultimately cause headaches, loss of sleep, and other frustrating and inconvenient conditions. Although individual rooms may be somewhat soundproofed, floors and ceilings typically cannot due to the lack of soundproofing products available for the floor installation process.

Furthermore, sound may travel horizontally thus disturbing occupants who reside on the same level. For example, a person who is exercising in a living room may create noise when jumping up and down or running in place. This sound may travel to other rooms on the same level and may thus disturb those who are in those rooms. A more effective solution is needed to dampen and reduce sound waves from multi-directional travel.

Various attempts have been made to solve the above-mentioned problems such as those found in U.S. Pat. No. 7,886,488 to Stephen W. Payne, Jr. et al; U.S. Pat. No. 6,576,577 to Kenneth B. Garner; U.S. Pat. No. 7,987,645 to Brandon Tinianov; U.S. Pub. No. 2006/0230699 to James R. Keene; U.S. Pat. No. 2004/0016184 to Robert J. Huebsch et al; and U.S. Pat. No. 5,867,957 to James S. Holtrop. This prior art is representative of sound dampening means. None of the above inventions and patents, taken either singly or in combination, is seen to describe the invention as claimed.

Ideally, a sound muffling system should be lightweight, durable, reasonably easy to install, and integrally comprise a sound muffling, leveling and insulating layer. The present invention is designed to operate reliably and be manufactured at a modest expense. Thus, a need exists for a reliable sound muffling flooring tile system to provide a flooring system for ideal use in a multi-story building or dwelling, wherein this unique flooring system may dampen sound waves produced when a user moves about thereby minimizing noise travel while also providing additional insulation and to avoid the above-mentioned problems.

BRIEF SUMMARY OF THE INVENTION

In view of the foregoing disadvantages inherent in the known flooring underlay art, the present invention provides a novel sonic foam-enhanced underlay board system; a sound muffling and insulating flooring underlay tile system.

The general purpose of the present invention, which will be described subsequently in greater detail, is to provide a novel sound muffling tile assembly which may comprise a solid base member, a cushiony foam layer, and a fastening means for securing the foam layer to the base member. A plurality of assembled sound muffling tiles may then be installed underneath a floor, which may serve to dampen and limit sound from traveling when a user moves about the floor. Furthermore, the cushiony foam layer of the present invention may serve as an insulator and as a leveler. As an insulator, the film layer of sound muffling tile assembly may help retain heat or cool air within a room.

The cushiony film layer of the present invention may comprise a flexible foam or rubber substrate. In one embodiment, the cushiony film layer may comprise reticulated foam. Furthermore, the base member may comprise a hard substrate such as plywood or a medium-density or high-density fiberboard. In its contemplated ideal use, the sound muffling underlay tile may serve to reduce noise from traveling between floors of a residential or professional building as a consequence of the cushiony film layer which serves as a sound wave dampener. Sound waves caused by movement on a floor may be obstructed from traveling to the floor beneath by the foam layer. The cushiony film layer may be securely attached to the base member via a fastening means. In one embodiment, the fastener may be glue. However, in other embodiments, the film layer may be otherwise attached to the base member via a double-sided adhesive or other suitable equivalent bonding may be used.

The present invention holds significant improvements and serves as a sound muffling flooring underlay tile systems. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, sonic foam-enhanced underlay board for the sound-muffling flooring underlay tile system, constructed and operative according to the teachings of the present invention.

The various embodiments of the present invention will hereinafter be described in conjunction with the appended drawings, wherein like designations denote like elements.

DETAILED DESCRIPTION

Figure 1:
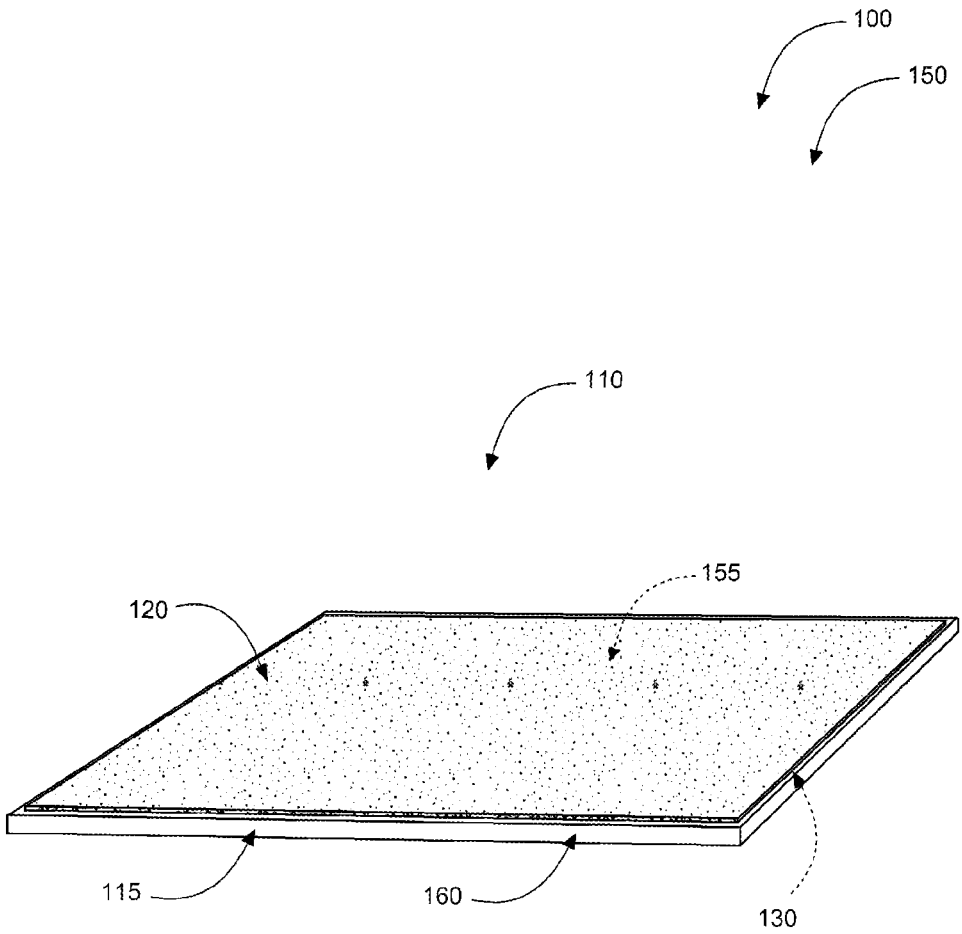
FIG. 1 is a perspective view illustrating sound-muffling flooring underlay tile systems comprising a sound-muffling tile assembly.

As discussed above, embodiments of the present invention relate to a sound-muffling system and more particularly to a sound-muffling flooring underlay tile system used to provide an additional sound barrier between floors within the same dwelling to inhibit the noise disturbance and sound pollution between individuals sharing a common commercial building or residence. In turning now to the drawings there is shown in FIG. 1, sound-muffling flooring underlay tile systems 100 in assembled condition 150 according to an embodiment of the present invention. Sound-muffling flooring underlay tile systems 100 may generally comprise sound-muffling tile assembly 110 which may be installed underneath a floor surface. Sound-muffling tile assembly 110 may comprise flooring base member 115, cushioning film layer 120, and fastener 130. In assembled condition 110, sound-muffling tile assembly 110 serves as a flooring underlay tile which may be optimally be installed with multiple sound-muffling tile assemblies 110 along a planar flooring surface. The present invention may be pre-assembled and in other embodiments may not.

In continuing to refer to FIG. 1, flooring base member 115 may comprise a hard, finished composite having a substantially planar surface and may be cut/manufactured in the shape of a rectangle or square. In one embodiment of sound-muffling flooring underlay tile systems 100, flooring base member 115 may comprise plywood 160. It should be noted that flooring base member 115 and cushioning film layer 120 comprises substantially approximate dimensions for when adhering them together for installation.

As further shown in FIG. 1, cushioning film layer 120 of sound-muffling tile assembly 110 may comprise a flexible composite comprising sound dampening and insulating characteristics. In a preferred embodiment of sound-muffling flooring underlay tile systems 100, cushioning film layer 120 may comprise foam 155. Foam 155 may comprise an open cell structure, such as reticulated foam, which may serve to muffle sound waves and provide insulation. Open-cell structured foams contain pores which may be connected to each other and form an interconnected network that is soft, flexible, and durable. For example in one embodiment of sound-muffling flooring underlay tile systems 100, foam 155 may comprise foam-rubber which may comprise an open-cell structure form.

In another embodiment of sound-muffling flooring underlay tile systems 100, foam 155 may comprise closed-cell foam, such as syntactic foam. Closed-cell foam may integrally comprise hollow particles embedded in a matrix material. One main advantage of syntactic foams is that they have a very high strength-to-weight ratio. Although open-cell structure is lighter in weight, the increased density of closed-cell foam may serve to further muffle sound from transferring through sound-muffling tile assembly 110 when in assembled condition 150 as shown in FIG. 1 as well as provide increased insulation characteristics. Depending on the application either foam structure may be used. It should be appreciated that the present invention is designed to meet building code such that its construction inhibits fire.

Figure 2:
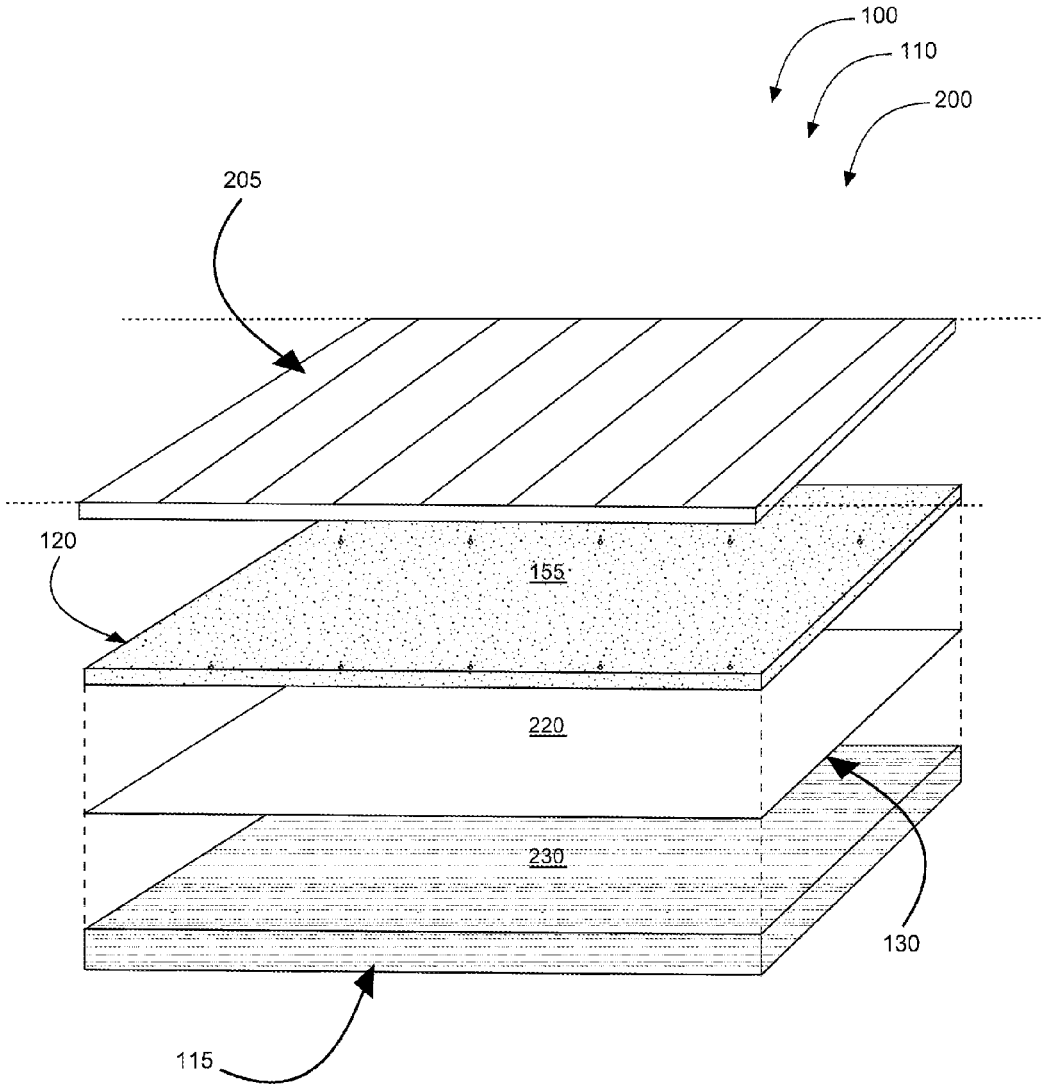
FIG. 2 is an exploded view illustrating the sound-muffling tile assembly comprising a flooring base member and a cushioning film layer which may be secured together via a fastener.

In referring now to FIG. 2, illustrating tile assembly exploded view 200 of sound-muffling flooring underlay tile systems 100. Sound-muffling tile assembly 110 may comprise flooring base member 115, cushioning film layer 120, and fastener 130. As shown, a bottom surface of cushioning film layer 120 is attachable to a top planar surface of flooring base member 115 via fastener 130. In the embodiment of the present invention shown in FIG. 2, flooring base member 115 may comprise fiberboard 230. It should be noted that fiberboard 230 may comprise high-density or medium-density fiberboard 230 for varying needs and applications. Cushioning film layer 120 may comprise foam 155 as shown and discussed in FIG. 1.

In still referring to FIG. 2, fastener 130 may comprise adhesive fastener 220. Adhesive fastener 220 may comprise a double-sided adhesive with bonding force sufficiently strong to securely attach cushioning film layer 120 to flooring base member 115. As further illustrated in FIG. 2, sound-muffling tile assembly 110 may be installed underneath floor 205 in such a manner that floor 205 is floated (and/or leveled) by cushioning film layer 120 comprising foam 155. It should be noted that cushioning film layer 120 may comprise a sequentially rollable composite for ease of installation.

Figure 3:
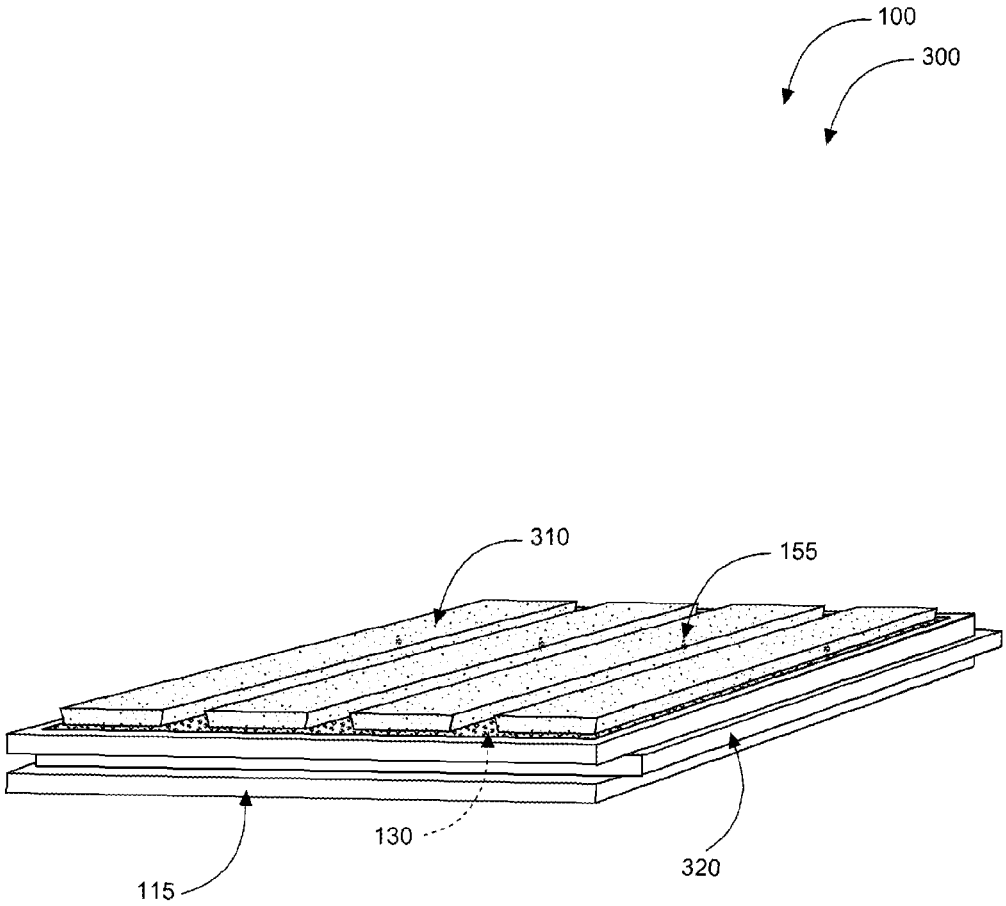
FIG. 3 is a perspective view illustrating the sound-muffling tile assembly wherein the cushiony film layer comprises slats, and the assembly comprises a tongue-and-groove profile, according to an alternative embodiment of the present invention of FIG. 1.

In referring now to FIG. 3, illustrating a perspective view of an alternative embodiment of sound-muffling flooring underlay tile systems 100.

As shown, sound-muffling flooring underlay tile systems 100 may comprise slatted tile assembly 300. This embodiment may comprise foam strips 310 which may be attached to a top surface of flooring base member 115 via fastener 130. As is further shown in FIG. 3, slatted tile assembly 300 may comprise tongue-and-groove profile 320. In such a manner, a tongue of one slatted tile assembly 300 may be connected to a groove of a second slatted tile assembly 300 via tongue-and-groove profile 320 for convenient attachment and installation. Foam strips 310 may be attached to top surface of flooring base member 115 via fastener 130, wherein fastener 130 comprises high-strength glue. It should also be noted that fastener 130 may comprise other equivalent high strength bonding substance, or other suitable fastening means.

Figure 4:
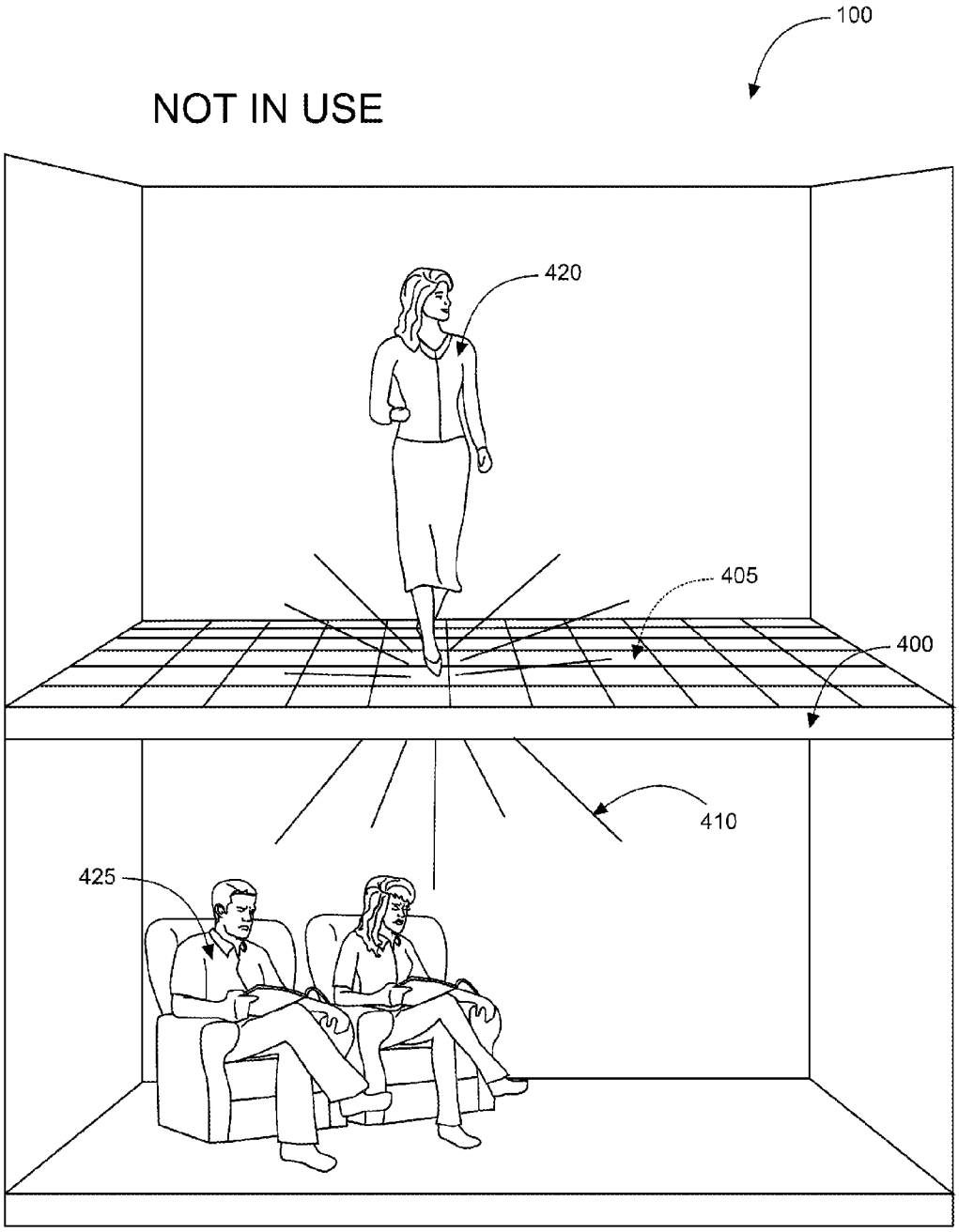
FIG. 4 is a perspective view of an interior of a two-story residence not using the present invention.

In referring now to FIG. 4, illustrating sound-muffling flooring underlay tile systems 100 without (before installing)

sound-muffling tile assembly 110. As shown by way of example of how the present invention is useful to retard sound propagation, upstairs tenant 420 is walking on non-sound muffling floor tile 405. As upstairs tenant 420 walks around, sound waves 410 are created by her footsteps as she moves about her apartment. Consequently, sound waves 410 travel through flooring substrate 400 comprising non-sound muffling floor tile 405 and into the living area beneath upstairs tenant 420. As a result, sound waves 410 may be heard by downstairs tenants 425, as shown in FIG. 4 and may result in noise disturbance leading to difficulty sleeping, working, reading, and enjoying a domicile with quiet enjoyment. Landlords may find use with the present invention to minimize complaints from tenants 425.

Figure 5:
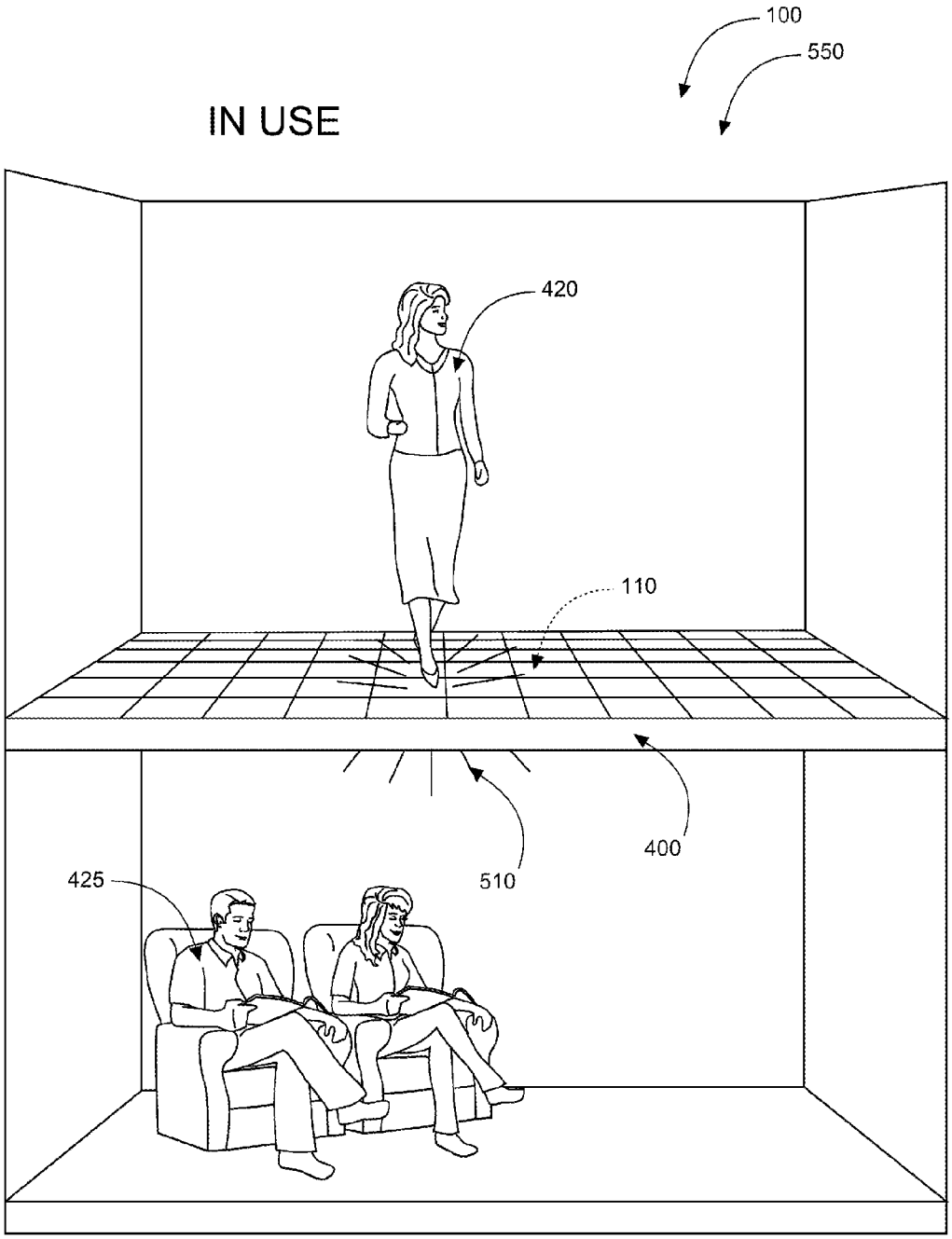
FIG. 5 is a perspective view illustrating the sound-muffling flooring underlay tile systems in an 'in-use' condition.

Referring now to FIG. 5, illustrating sound-muffling flooring underlay tile systems 100 in an 'in use' condition 150 according to an embodiment of the present invention of FIG. 1.

As shown, upstairs tenant 420 is walking on flooring substrate 400 comprising sound-muffling tile assembly 110. As upstairs tenant 420 moves around, sound waves 410 created by her footsteps are muffled as they pass through flooring substrate 400. As shown in FIG. 5, sound waves 410 that travel through sound-muffling tile assembly 110 comprising cushioning film layer 120 flooring substrate 400 convert into dampened sound wave 510 when entering the living area beneath upstairs tenant 420. It should be appreciated that dampened sound wave 510 may be largely inaudible to downstairs tenants 425 as a result of sound wave 410 passing through cushioning film layer 120 of sound-muffling tile assembly 110. When compared to FIG. 4, the reader is able to see the inherent improvement over existing systems with respect to minimized sound propagation. Further the present invention also serves to level flooring surfaces.

As previously mentioned, sound-muffling flooring underlay tile systems 100 is a sound-muffling and noise-dampening tile underlay system which may be installed underneath a floor surface for reducing noise transfer between rooms and between floors within a building or dwelling. Sound-muffling flooring underlay tile systems 100 may comprise sound-muffling tile assembly 110. Sound muffling tile assembly 110 may comprise flooring base member 115, cushioning film layer 120, and fastener 130. Flooring base member 115 and cushioning film layer 120 may comprise approximately identical dimensions. In assembled condition 150, bottom surface of cushioning film layer 120 is attachable to a top planar surface of flooring base member 115 via fastener 130. Cushioning film layer 120 may comprise foam 155. Foam 155 may comprise an open cell structure, such as reticulated foam, which may serve to muffle sound waves and provide insulation. Open-cell structured foams contain pores which may be connected to each other and form an interconnected network that is soft, flexible, and sufficiently durable. In one embodiment of sound-muffling flooring underlay tile systems 100, foam 155 may comprise foam-rubber which may comprise an open-cell structure form. Flooring base member 115 may comprise plywood 160. Fastener 130 may comprise adhesive fastener 220 for adhering cushioning film layer 120 to flooring base member 115. Alternatively, sound-muffling flooring underlay tile systems 100 may comprise slatted tile assembly 300 comprising a plurality of foam strips 310 attached to a top surface of flooring base member 115. It should be noted that slatted tile assembly 300 may comprise tongue-and-groove profile 320 for ease of inter-connecting.

A kit may be provided for sale of the present invention. Upon reading this specification, it should be appreciated that, under appropriate circumstances, considering such issues as design preference, user preferences, marketing preferences, cost, structural requirements, available materials, technological advances, etc., other kit contents or arrangements such as, for example, including underlays, fasteners such as adhesives or the like, different flooring combinations, parts may be sold separately, etc., may be sufficient.

Figure 6:
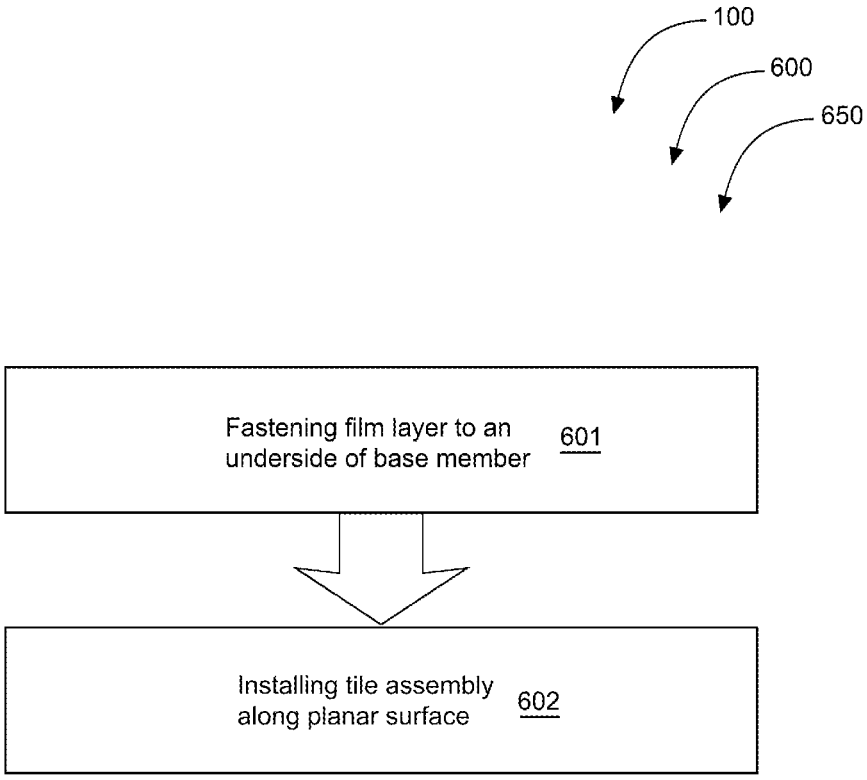
FIG. 6 is a flowchart illustrating a method of use for the present invention of FIGS. 1-3 and 5.

FIG. 6 shows flowchart 650 illustrating method of use 600 of sound-muffling flooring underlay tile systems 100 according to a preferred embodiment of the present invention of FIGS. 1-3 and 5. Method of use 600 may comprise the steps of: step one 601 fastening cushioning film layer 120 to an underside of flooring base member 115 via fastener 130, and step two 602 installing sound-muffling tile assembly 110 along a planar surface underneath floor 205.

It should be noted that the steps described in the method of use can be carried out in many different orders according to user preference. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, installing pre-assembled systems, installing non-preassembled systems, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A sound-muffling tiling system for installing on a planar surface comprising:

a) at least one sound-muffling tile assembly comprising;
   i) at least one flooring base member;
   ii) at least one floor surface leveler;
   iii) at least one sound-absorbing, insulating, and cushioning syntactic foam layer; and
   iv) at least one fastener;

b) wherein said at least one flooring base member and said at least one sound-absorbing, insulating, and cushioning film layer comprise approximately identical dimensions;

c) wherein said at least one sound-absorbing, insulating, and cushioning film layer serves to provide a floating and leveled surface;

d) wherein said at least one sound-absorbing, insulating, and cushioning syntactic foam[1] layer comprises a cellular matrix and hollow particles that are smaller than cell-size of said cellular matrix, whereby creating sound dampening, floor surface leveler, and load bearing characteristics;

e) wherein said at least one flooring base member and said at least one sound-absorbing, insulating, and cushioning film layer are secured together via said at least one fastener; and f) wherein said sound-muffling tile assemblies are installable adjacent to one another on said planar surface to absorb sound thereby serving to minimize sound propagation between living areas.

2. The sound-muffling tiling system of claim 1, wherein said cellular matrix of said at least one sound-absorbing, insulating, and cushioning syntactic foam layer comprises an open cell structure.

3. The sound-muffling tiling system of claim 2, wherein said cellular matrix of said at least one sound-absorbing, insulating, and cushioning syntactic foam layer comprises reticulated structure.

4. The sound-muffling tiling system of claim 1, wherein said cellular matrix of said at least one sound-absorbing, insulating, and cushioning syntactic foam layer comprises closed-cell structure.

5. The sound-muffling tiling system of claim 2, wherein said cellular matrix of said at least one sound-absorbing, insulating, and cushioning syntactic foam layer includes hollow particles.

6. The sound-muffling tiling system of claim 1, wherein said at least one sound-absorbing, insulating, and cushioning syntactic foam layer comprises a sequentially rollable composite.

7. The sound-muffling tiling system of claim 1, wherein said at least one sound-absorbing, insulating, and cushioning syntactic foam layer comprises slats.

8. The sound-muffling tiling system of claim 7, wherein said wherein said slats comprise a tongue-and-groove profile.

9. The sound-muffling tiling system of claim 1, wherein said flooring base member comprises plywood.

10. The sound-muffling tiling system of claim 1, wherein said at least one flooring base member comprises medium-density fiberboard.

11. The sound-muffling tiling system of claim 1, wherein said at least one flooring base member comprises high-density fiberboard.

12. The sound-muffling tiling system of claim 1, wherein said at least one flooring base member comprises medium-density fiberboard.

13. The sound-muffling tiling system of claim 1, wherein said at least one fastener comprises glue.

14. The sound-muffling tiling system of claim 1, wherein said at least one fastener comprises a bonding agent.

15. The sound-muffling tiling system of claim 1, wherein said at least one fastener comprises an adhesive.

16. The sound-muffling tiling system of claim 1, wherein said at least one flooring base member and said at least one sound-absorbing, insulating, and cushioning syntactic foam layer comprises a square shape.

17. The sound-muffling tiling system of claim 1, wherein said at least one flooring base member and said at least one sound-absorbing, insulating, and cushioning syntactic foam layer comprises a rectangular shape.

18. A sound-muffling tiling system for installing on a planar surface comprising:

a) at least one sound-muffling tile assembly comprising;
   i) at least one flooring base member comprising high-density fiberboard;
   ii) at least one floor surface leveler;
   iii) at least one sound-absorbing, insulating, and cushioning syntactic foam layer comprising an open cell structure, wherein said open cell structure comprises reticulated foam, wherein said reticulated foam comprises a sequential roll; and
   iv) at least one fastener, comprising glue;

b) wherein said at least one flooring base member and said at least one sound-absorbing, insulating, and cushioning syntactic foam layer comprise approximately identical dimensions;

c) wherein said at least one sound-absorbing, insulating, and cushioning syntactic foam layer comprises a cellular matrix and hollow particles that are smaller than cell-size of said cellular matrix, whereby creating sound dampening, floor surface leveler, and load bearing characteristics;

d) wherein said at least one flooring base member and said at least one sound-absorbing, insulating, and cushioning syntactic foam layer are secured together via said at least one fastener; and wherein said sound-muffling tile assemblies are installable adjacent to one another thereby forming a continuous surface on said planar surface; and wherein said continuous surface comprising a plurality of said sound-muffling tile assemblies serve to dampen sound thereby minimizing sound propagation between living areas.

19. A method of using the sound-muffling tiling system of claim 1 to muffle sound comprising the steps of:

a) fastening said at least one sound-absorbing, insulating, and cushioning syntactic foam layer to the underside of said at least one flooring base member thereby creating a said sound-muffling tile assembly; and b) installing said sound-muffling tile assembly on a planar surface adjacent to another said sound-muffling tile assembly.

* * * * *